United States Patent [19]

True et al.

[11] Patent Number: 4,821,646

[45] Date of Patent: Apr. 18, 1989

[54] DELAY INITIATOR FOR BLASTING

[75] Inventors: Donald C. True; Raymond Carrière, both of Brownsburg, Canada

[73] Assignee: CXA Ltd./CXA Ltee, Montreal, Canada

[21] Appl. No.: 116,707

[22] Filed: Nov. 4, 1987

[30] Foreign Application Priority Data

Jun. 29, 1987 [CA] Canada ..... 540857

[51] Int. Cl.[4] ..... F42B 3/00

[52] U.S. Cl. ..... 102/322; 102/202.9; 102/202.13; 102/202.14; 102/275.6

[58] Field of Search ..... 102/322, 275.6, 202.2, 102/202.9, 202.13, 202.14

[56] References Cited

U.S. PATENT DOCUMENTS

| | | | |
|---|---|---|---|
| 2,842,059 | 7/1958 | Plumley et al. | 102/70.2 |
| 2,960,933 | 11/1960 | Scherrer | 102/28 |
| 3,135,200 | 6/1964 | Jackson | 102/28 |
| 3,611,939 | 10/1971 | Stadler et al. | 102/46 |
| 3,867,885 | 2/1975 | Gawlick et al. | 102/28 R |
| 3,885,499 | 5/1975 | Hurley | 102/23 |
| 4,718,345 | 1/1988 | Yunan | 102/275.3 |

*Primary Examiner*—Peter A. Nelson

*Attorney, Agent, or Firm*—Donald G. Ballantyne

[57] ABSTRACT

A novel initiator (blasting cap) for explosives is provided. The initiator, which may be electric or non-electric, comprises a tubular metal shell having within a base charge, a delay train, a priming charge and an ignition means. Interposed between the delay train and the priming charge is an annular collar or ring of resilient material in contact with the inner wall of the metal shell. The construction results in a markedly improved resistance against shock initiation.

5 Claims, 1 Drawing Sheet

FIG. 1 PRIOR ART
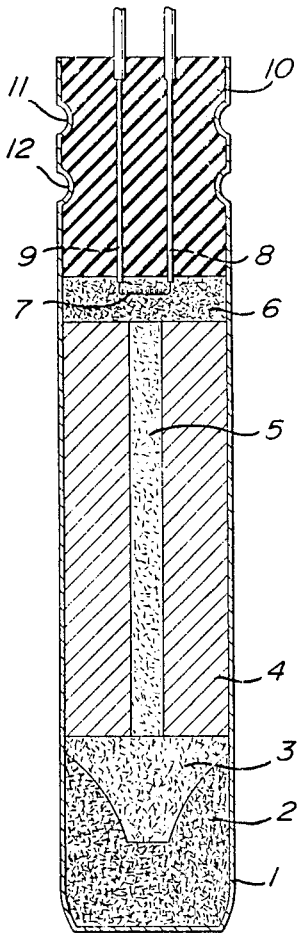
FIG. 2
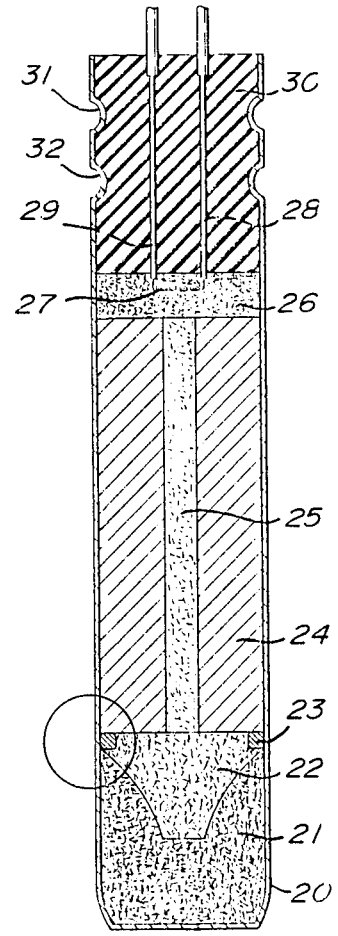
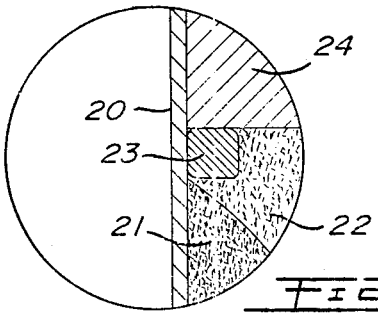
FIG. 3

DELAY INITIATOR FOR BLASTING

This invention relates to blasting initiators, and more particularly, to both electric and non-electric initiators of the delay type which demonstrate improved resistance to shock initiation.

BACKGROUND OF THE INVENTION

Delay blasting initiators or detonators are well known in the art and normally consist of a metal or plastic shell or tube, closed at one end and containing a base charge of a secondary explosive, such as pentaerythritol tetranitrate (PETN), and a priming charge of a primary explosive such as lead azide located immediately above the base charge. A delay element is placed above the priming charge and an ignition charge is located above the delay element. The delay element introduces a time lag between the activation of the ignition charge and the detonation of the base charge. The ignition charge is activated electrically in an electric detonator and by means of energy provided by a detonating cord or shock tube in a non-electric detonator.

In multiple charge blasting operations, a number of closely spaced explosive-charged boreholes are advantageously detonated in a planned sequence employing mil-second (MS) delay blasting detonators. Use of such split-second techniques results in substantially improved blasting results in terms of improved fragmentation, reduced vibration and backbreak and minimized cut-offs. Briefly described, in split-second blasting, a single charged borehole or a row of charged holes is detonated at one point in time, a second adjacent charged hole or row of charged holes is detonated at a later mil-second interval, a third charged row at a further short delayed interval, etc. The delay between each detonation is achieved by providing blasting detonators having a built-in delay feature, the delays ranging from about 10 MS to about 9000 MS.

A problem which has persisted in the use of split-second delay blasting techniques has been the inadvertent, premature detonation of blasting detonators in nearby holes caused by shock transmitted through the terrain from an earlier detonated charge. When this occurs, the carefully planned sequence of delay blasting is upset resulting in unsatisfactory blasting results.

SUMMARY OF THE INVENTION

It is an object of the present invention to provide a delay blasting detonator which demonstrates a substantially improved resistance against shock initiation with no loss in output energy. Additional objects of the invention will be evident upon consideration of the ensuing description.

The improved shock resistant delay blasting detonator of the invention comprises essentially a tubular cup-shaped metal shell, a base charge of explosive in the shell, a priming charge adjacent the base charge, a delay train above the priming charge, and an ignition means above the delay train, the improvement comprising an annular collar of resilient material interposed between the said priming charge and delay train, the collar being in tight-fitting contact with an inner wall of the tubular metal shell.

In an electric detonator, the means to initiate the delay element may consist of a fine bridge wire embedded in an ignitable composition and supported by a plug of insulating material. In a non-electric detonator, the initiating means may be an ignitable composition against which the end of a detonating cord or shock tube can be secured.

BRIEF DESCRIPTION OF THE DRAWING

The detonator of the invention may be more fully illustrated by reference to the accompanying drawing wherein:

FIG. 1 is a cross-sectional longitudinal view of an electric delay detonator according to the prior art;

FIG. 2 is a cross-sectional longitudinal view of a typical electric blasting detonator of the present invention; and FIG. 3 is an enlargement of the circled area in FIG. 2.

Referring to FIG. 1, 1 is an elongated tubular cup-shaped rigid shell of, for example, aluminum, 2 is a base charge of detonating explosive, for example, pentaerythritol tetranitrate (PETN), 3 is a priming charge of a primary explosive, for example, lead azide, mercury fulminate or lead styphnate, 4 is a malleable metal delay train carrying a delay charge 5 of, for example, a silicon/red lead mixture, 6 is a an ignition charge of, for example, a boron/red lead mixture, 7 is a bridge wire embedded in the ignition charge 6, and 8 and 9 are connecting leg wires held within the end of shell 1 by means of a plug 10. Peripheral crimps are shown at 11 and 12.

In the assembly of the detonator depicted in FIG. 1, the base charge 2 is introduced into shell 1 and pressed with a pointed end or rounded end rod or pin which produces a depression or recess on the surface of charge 2. Priming charge 3 is then placed into shell 1, filling the recess in base charge 2. The charge 3 may optionally be pressed. During this operation, small amounts of grain matter comprising priming charge 3 are inadvertently distributed above charge 3 and adhere against the inner wall of shell 1. Delay carrier or train 4 is then pressed into shell 1, frequently trapping grain particles of priming charge 3 between train 4 and the inner wall of shell 1. Ignition charge 6 is introduced into shell 1 as a loose powder after which an assembly comprising bridge wire 7, leg wires 8 and 9 and plug 10 are pressed into shell 1 until the base of plug 10 is flush with the surface of charge 6 and bridge wire 7 is embedded in charge 6. Peripheral crimps 11 and 12 secure plug 10 within shell 1.

Detonators of the type shown in FIG. 1 can be initiated sympathetically when exposed to pressures of 8000–9000 psi in underwater shock tests. It has been postulated that this high level of shock sensitivity is due, in large part, to the compressed and confined particles of the primary explosive priming charge which are trapped between the shell wall and the delay carrier 4. From the foregoing description, it is apparent that when the delay train 4 is located within shell 1 and pressed into place, any particles of the priming explosive, (e.g. lead azide) which are present on the inner wall of the shell from the earlier pressing step, will be secured in that position. It is known in the art that compressed and confined fine particles of primary explosive, such as, lead azide provides a particularly shock-sensitive configuration. The improved detonator of the present invention, as shown in FIG. 2, provides a substantially shock-insensitive construction.

DESCRIPTION OF PREFERRED EMBODIMENT

Referring to FIGS. 2 and 3, 20 is an elongated, tubular, cup-shaped, rigid shell of, for example, aluminum, 21 is a base charge of detonating explosive, for example, PETN, and 22 is priming charge of, for example, lead azide or lead styphnate. A tight-fitting, annular ring or collar 23 of a resilient material, such as, low density polyethylene, is indented into priming charge 22. A malleable metal (e.g. lead) delay train 24 carrying a delay charge 25 of, for example, silicon/red lead mixture rests upon collar 23 and the upper surface of priming charge 22. An ignition charge 26 of, for example, a boron/red lead mixture is adjacent delay train 24. An ignition bridge wire is embedded in ignition charge 26 and connecting leg wires 28 and 29 are held within shell 20 by means of resilient plug 30. Peripheral crimp are shown at 31 and 32.

In the assembly of the detonator of the present invention as shown in FIG. 2, the base charge 21 is introduced into shell 20 and pressed into place with a pointed end or rounded end pin which produces a depression or recess on the surface of base charge 21. Priming charge 22 is introduced and pressed into the depression in base charge 21. Resilient, tight-fitting, annular ring 23 is pressed downward along the inner wall of shell 20 to rest close to the surface of priming charge 22. During its passage, ring 23 effectively sweeps any fine particles of priming charge material 22 which may be adhering to the inner wall of shell 20. Delay train or carrier 24 is then pressed into shell 20 and against ring 23, the pressing action displacing some of the material of the priming charge 22 towards the axial centre of shell 20. The lower end of delay carrier 24 is then in physical contact with the surface of priming charge 22. Ignition charge 26 is introduced into shell 20 as a loose powder after which an assembly comprising leg wires 28 and 29, connected bridge wire 27 and plug 30 are pressed into shell 20 until the base of plug 30 is flush with the surface of ignition charge 26 and bridge wire 27 is embedded in charge 26. Peripheral crimps 31 and 32 secure plug 30 within shell 20.

The detonator of the present invention is particularly adapted to withstand the shock of impact which is often present in multiple charge blasting operations. To demonstrate the substantially improved shock resistance of the detonator of the present invention, testing was undertaken as described in the following Examples.

EXAMPLE I

Underwater shock tests were conducted in a quarry pond. Explosive charges comprising 205 grams of pentolite (a 50/50 PETN/TNT mixture) were detonated underwater and a series of detonators of various manufacture were placed at varying distances from the explosive charges. The pressure generated by the explosive charge at various distances is shown below in Table I.

TABLE I

| Pressure (psi) | Distance (cm) |
|---|---|
| 21500 | 20 |
| 12000 | 40 |
| 7000 | 60 |
| 4500 | 80 |
| 2500 | 100 |

As will be obvious, detonators having the greatest shock resistance will withstand the greater pressure. The results of the shock tests are shown in Table II, below.

TABLE II

| PSI | Product A | Product B | Product C | Product D | Product E | Product F** | Present Invention |
|---|---|---|---|---|---|---|---|
| 5000 | | | | | | | |
| 6000 | | | | | | | |
| 7000 | | | | | | | |
| 8000 | | | | | | | |
| 9000 | * | | | * | * | | |
| 10000 | | * | * | | | | |
| 11000 | | | | | | | |
| 12000 | | | | | | | |
| 13000 | | | | | | | |
| 14000 | | | | | | * | |
| 15000 | | | | | | | |
| 16000 | | | | | | | |
| 17000 | | | | | | | |
| 18000 | | | | | | | |
| 19000 | | | | | | | * |
| 20000 | | | | | | | |

*Pressure at which sympathetic initiation occurs.
**Sample F is designed for high pressure, containing lead azide in a rigid element.

As will be seen from the results in Table II, the detonators of the present invention were able to withstand substantially greater pressures than those of the prior art products.

EXAMPLE II

In a field trial conducted in a limestone quarry, two detonators of the present invention were placed in vertical boreholes at distances of four and five feet, respectively, from an adjacent borehole containing 137.5 pounds of slurry explosive blasting agent. The explosive in the donor hole was initiated with a short period delay detonator, No. 4, which has a nominal delay time of 100 milliseconds, the two receptor holes contained No. 5 short delay detonators which have a delay time of 128 milliseconds. The detonators in all three holes were initiated at the same time. The expected nominal time difference between the donor hole and the two receptor holes is 28 milliseconds. When the shot was fired, the receptor holes were timed at 27.6 and 26.9 milliseconds, respectively. Normally, detonators are considered to be within specification if their timing results are within ten percent of the nominal (i.e., 25.2 to 30.8 ms). Thus, the detonators of the present invention showed no evidence of premature initiation.

Regular non-electric detonators tested under the same conditions did not give correct timing results.

When an 82.5 pound donor charge was detonated, the regular detonators in the two receptor holes gave timing results of five and sixteen milliseconds and, thus, were initiated prematurely. It was found that regular detonators only started to function normally when the donor charge was reduced to 27.5 pounds.

The above tests were performed under worst case conditions in water-saturated limestone with no free face. The test charges were totally confined and coupled to the donor charge. It is clear from these test results that a regular detonator could not function acceptably in this region (i.e., 4 feet from 82.5 lbs. of explosives) whereas the detonator of the present invention was shown to be able to perform well in excess of the normal limits required.

The material of construction of the shell 20 is preferably aluminum although other materials, such as, copper or molded plastics may be used. As noted heretofore, the annular collar 23 is preferably low density polyethylene of a density of from 0.91 to 0.93, although other resilient but firm materials, such as, rubber, polyurethane and the like may be employed. The collar 23 is, preferably, rectangular in cross-section and has rounded edges. In some cases, a near circular cross-sectional collar may be employed. The size of the collar 23 will be chosen so that it will not interfere with the functioning of the detonator yet will provide the desired wiping action against the inner wall of shell 20. In a conventional detonator having an inner shell diameter of 0.260/0.258 a collar size of O.D. 0.26", and I.D. of 0.195" and a thickness of 0.06" has proven satisfactory.

From the foregoing, it is apparent that the novel detonator of the invention provides a substantial improvement in shock resistance compared to all conventional products tested and its use will result in a measurable increase in efficiency wherever multiple charge delay blasting is employed.

We claim:

1. An improved time-delay blasting initiator of the type comprising a tubular metal shell, a base charge of explosive in the shell, a priming charge adjacent the base charge, a delay train above said priming charge and an ignition means above said delay train, the improvement comprising an annular collar of resilient material interposed between the said delay train and the said priming charge, the said collar being in tight-fitting contact with an inner wall of the said tubular metal shell.

2. An improved blasting initiator as claimed in claim 1 wherein the said annular collar comprises polyethylene of a density of from 0.91 to 0.93.

3. An improved blasting initiator as claimed in claim 1 wherein the said annular collar is rectangular in cross-section.

4. An improved blasting initiator as claimed in claim 1 wherein the said annular collar is circular in cross-section.

5. An improved blasting initiator as claimed in claim 1 wherein the said annular collar is indented into a peripheral edge of the said priming charge.

* * * * *